US008936092B2

(12) United States Patent
Nguyen et al.

(10) Patent No.: US 8,936,092 B2
(45) Date of Patent: Jan. 20, 2015

(54) SEAL SYSTEM AND METHOD

(71) Applicant: Cameron International Corporation, Houston, TX (US)

(72) Inventors: Dennis P. Nguyen, Pearland, TX (US); Thomas E. Taylor, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 13/736,916

(22) Filed: Jan. 8, 2013

(65) Prior Publication Data

US 2013/0118753 A1 May 16, 2013

Related U.S. Application Data

(63) Continuation of application No. 12/669,561, filed as application No. PCT/US2008/064153 on May 19, 2008, now Pat. No. 8,347,966.

(60) Provisional application No. 60/950,844, filed on Jul. 19, 2007.

(51) Int. Cl.
*E21B 23/00* (2006.01)
*E21B 33/04* (2006.01)

(52) U.S. Cl.
CPC ..... *E21B 23/00* (2013.01); *E21B 33/04* (2013.01)
USPC ..... 166/345; 166/338; 166/348; 166/387; 166/85.3

(58) Field of Classification Search
CPC ..... E21B 23/00; E21B 33/04
USPC ..... 166/345, 338, 339, 348, 360, 368, 166/378–382, 387, 85.3, 75.14; 277/322, 277/323, 337–339, 342
See application file for complete search history.

(56) References Cited

U.S. PATENT DOCUMENTS

| | | | | | |
|---|---|---|---|---|---|
| 3,404,736 | A | * | 10/1968 | Nelson et al. | 166/89.1 |
| 3,897,823 | A | * | 8/1975 | Ahlstone | 166/120 |
| 4,019,580 | A | * | 4/1977 | Garrett | 166/387 |
| 4,595,063 | A | * | 6/1986 | Jennings et al. | 166/382 |
| 4,611,663 | A | * | 9/1986 | Goris et al. | 166/382 |
| 4,691,780 | A | * | 9/1987 | Galle et al. | 166/348 |
| 4,823,871 | A | * | 4/1989 | McEver et al. | 166/182 |
| 4,836,288 | A | * | 6/1989 | Wester | 166/348 |
| 4,900,041 | A | * | 2/1990 | Hopkins et al. | 277/328 |
| 4,949,786 | A | * | 8/1990 | Eckert et al. | 166/208 |
| 5,069,288 | A | * | 12/1991 | Singeetham | 166/348 |
| 5,163,514 | A | * | 11/1992 | Jennings | 166/368 |
| 5,174,376 | A | * | 12/1992 | Singeetham | 166/208 |
| 5,307,879 | A | * | 5/1994 | Kent | 166/382 |
| 5,456,321 | A | * | 10/1995 | Shiach et al. | 166/382 |
| 5,725,056 | A | * | 3/1998 | Thomson | 166/382 |

* cited by examiner

*Primary Examiner* — Matthew Buck
(74) *Attorney, Agent, or Firm* — Fletcher Yoder P.C.

(57) ABSTRACT

A system in some embodiments includes a system, having a seal assembly, including an inner energizing ring, an outer energizing ring, a load ring disposed between the inner energizing ring and the outer energizing ring, a sealing element, and a lock ring. Further other embodiments provide a method of sealing, including rotating an inner energizing ring in a direction to move the inner energizing ring in a first axial direction to seat a seal, rotating an outer energizing ring in the direction to wedgingly engage and set a lock ring in a radial direction, and rotating a load ring in the direction to move the load ring in a second axial direction to set the lock ring.

32 Claims, 15 Drawing Sheets

SEAL SYSTEM AND METHOD

CROSS REFERENCE TO RELATED APPLICATION

This application claims priority to and benefit of U.S. patent application Ser. No. 12/669,561, entitled "Seal System and Method," filed Jan. 18, 2010, which is herein incorporated by reference in its entirety, and which claims priority to and benefit of PCT Patent Application No. PCT/US2008/064153, entitled "Seal System and Method," filed May 19, 2008, which is herein incorporated by reference in its entirety, and which claims priority to and benefit of U.S. Provisional Patent Application No. 60/950,844, entitled "Seal System and Method", filed on Jul. 19, 2007, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are often employed to access and extract the resource. These systems can be located onshore or offshore depending on the location of a desired resource. Further, such systems generally include a wellhead assembly through which the resource is extracted. These wellhead assemblies generally include a wide variety of components and/or conduits, such as various control lines, casings, valves, and the like, that control drilling and/or extraction operations.

In drilling and extraction operations, various components and tools, in addition to and including wellheads, are employed to provide for drilling, completion, and production of a mineral resource. Further, during drilling and extraction operations, one or more seals may be employed to regulate pressures and the like. For instance, a wellhead system often includes a tubing hanger or casing hanger that is disposed within the wellhead assembly and configured to secure tubing and casing suspended in the well bore. The hanger generally provides a path for hydraulic control fluid, chemical injections, or the like to be passed through the wellhead and into the well bore. Accordingly, the hanger may include an annular seal that is compressed between a body of the hanger and a component of the wellhead (e.g., a tubing spool) to seal off an annular region between the hanger and the wellhead. The annular seal generally prevents pressures of the well bore from manifesting through the wellhead, and may enable the wellhead system to regulate the pressure within the annular region.

Generally, the annular seal is provided as a component of the hanger that is installed and engaged after the hanger has been landed in the wellhead assembly. In other words, the hanger is run down to a subsea wellhead, followed by the installation of the seal. Installation of the annular seal generally includes procedures such as setting and locking the seal (e.g., compressing the seal such that is does not become dislodged). Accordingly, installation of the seal may include the use of several tools and procedures to set and lock the seal. For example, the annular seal may be run from an offshore vessel (e.g., a platform) to the wellhead via a seal running tool coupled to a drill stem. After the seal running tool is retrieved, a second tool may be run to the wellhead to engage the seal. After the second tool is retrieved, a third tool may be run down to preload the seal. The third tool may then be retrieved to the offshore vessel. Unfortunately, each sequential running procedure may require a significant amount of time and cost. For example, each run of a tool may take several hours, which may translate into a significant cost when operating an offshore vessel. Further, the use of multiple tools may also introduce increased complexity and cost.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
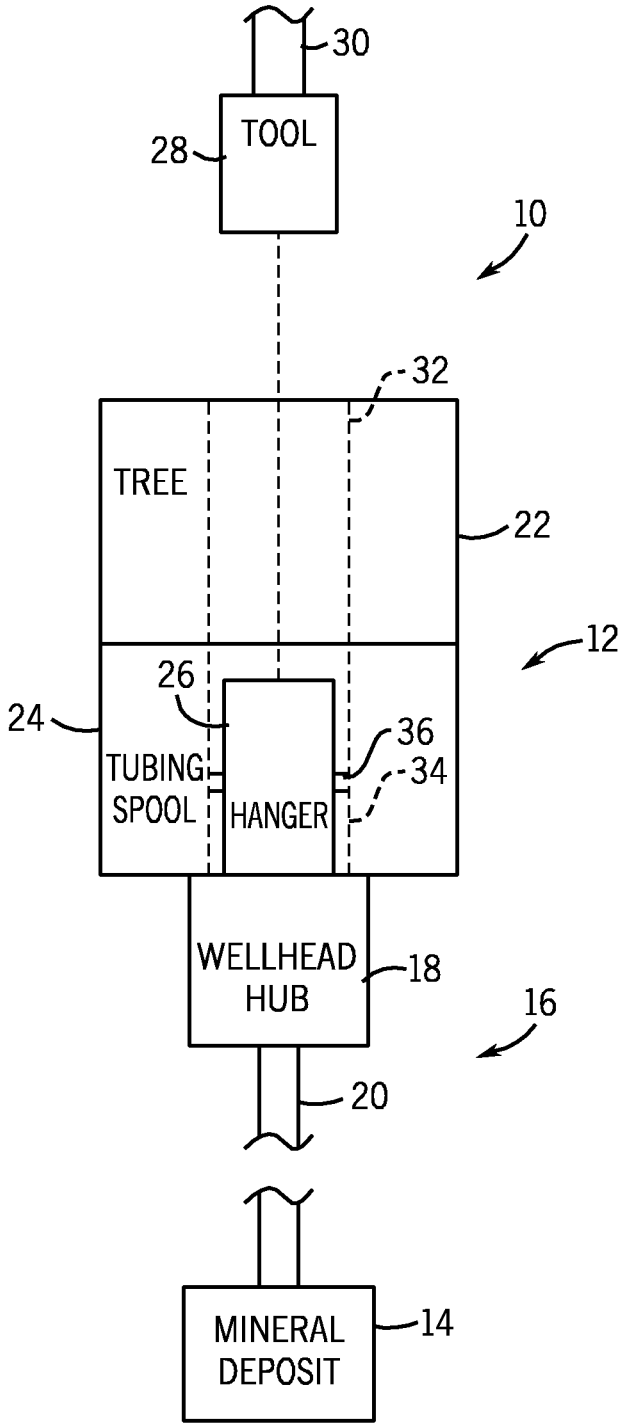
FIG. 1 illustrates a mineral extraction system in accordance with an embodiment of the present technique.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Certain exemplary embodiments of the present technique include a system and method that addresses one or more of the above-mentioned inadequacies of conventional systems and methods of sealing. As explained in greater detail below, the disclosed embodiments may include a sealing system having an annular seal, and an annular seal running tool that may seat (e.g., compress) and lock (e.g., preload) the annular seal in a single trip from an offshore vessel to a wellhead. In certain embodiments, the annular seal is seated and locked in place by rotation in a single direction. For example, in one embodiment, the annular seal may include an inner energizing member that is rotated in a first direction to seat the annular seal and to align a lock ring with a locking groove, an outer energizing member that is rotated in the first direction to bias the lock ring into the locking groove, and a load ring that is rotated in the first direction to urge the lock ring against a surface to lock the seal in place. In certain embodiments, the annular seal running tool provides torque to rotate the annular seal components. For example, one embodiment of the annular seal running tool may include an inner body that transmits a rotational torque to the inner energizing member, and an outer body that transmits a rotational torque to the outer body and the load ring. In certain embodiments, the annular seal running tool may provide torque in multiple stages. For example, in one embodiment, the annular seal running tool may include shear pins that transmit the torque from a rotating coupler to the inner body in a first stage, and engagement pins that transmit torque from the coupler to outer body in a second stage. Accordingly, certain embodiments of seating and locking the annular seal in a single trip may include running the annular seal and the annular seal running tool to the wellhead, rotating the annular sealing running tool in a single direction to seat and lock the annular seal, and retrieving the annular seal running tool.

FIG. 1 illustrates a mineral extraction system 10. The illustrated mineral extraction system 10 can be configured to extract various minerals and natural resources, including hydrocarbons (e.g., oil and/or natural gas), for instance. Further, the system 10 may be configured to inject substances. In some embodiments, the mineral extraction system 10 is land-based (e.g., a surface system) or subsea (e.g., a subsea system). As illustrated, the system 10 includes a wellhead 12 coupled to a mineral deposit 14 via a well 16. For example, the well 16 includes a wellhead hub 18 and a well-bore 20.

The wellhead hub 18 may include a large diameter hub that is disposed at the termination of the well bore 20 near the surface. Thus, the wellhead hub 18 may provide for the connection of the wellhead 12 to the well 16. In the illustrated system 10, the wellhead 12 is disposed on top of the wellhead hub 18. The wellhead 12 may be coupled to a connector of the wellhead hub 18, for instance. In one embodiment, the wellhead hub 18 includes a DWHC (Deep Water High Capacity) hub manufactured by Cameron, headquartered in Houston, Tex. Accordingly, the wellhead 12 may include a complementary connector. For example, in one embodiment, the wellhead 12 includes a collet connector (e.g., a DWHC connector), also manufactured by Cameron.

The wellhead 12 generally includes a series of devices and components that control and regulate activities and conditions associated with the well 16. For example, the wellhead 12 may provide for routing the flow of produced minerals from the mineral deposit 14 and the well bore 20, provide for regulating pressure in the well 16, and provide for the injection of chemicals into the well bore 20 (down-hole). In the illustrated embodiment, the wellhead 12 includes what is colloquially referred to as a christmas tree 22 (hereinafter, a tree), a tubing spool 24, and a hanger 26 (e.g., a tubing hanger or a casing hanger). The system 10 may also include devices that are coupled to the wellhead 12, and those that are used to assemble and control various components of the wellhead 12. For example, in the illustrated embodiment, the system 10 also includes a tool 28 suspended from a drill string 30. In certain embodiments, the tool 28 may include running tools that are lowered (e.g., run) from an offshore vessel to the well 16, the wellhead 12, and the like.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the illustrated tree 22 includes a tree bore 32. The tree bore 32 may provide for completion and workover procedures, such as the insertion of tools (e.g., the hanger 26) into the well 16, the injection of various chemicals into the well 16 (down-hole), and the like. Further, minerals extracted from the well 16 (e.g., oil and natural gas) may be regulated and routed via the tree 22. For instance, the tree 12 may be coupled to a jumper or a flowline that is tied back to other components, such as a manifold. Accordingly, produced minerals flow from the well 16 to the manifold via the wellhead 12 and/or the tree 22 before being routed to shipping or storage facilities.

The tubing spool 24 may provide a base fore the wellhead 24 and/or an intermediate connection between the tree 22 and the wellhead hub 18. For example, in some systems 10, the tubing spool 24 is run down from an offshore vessel and is secured to the wellhead hub 18 prior to the installation of the tree 22. Accordingly, the tubing spool 24 provides one of many components in a modular subsea mineral extraction system 10. Similar to the tree 22, the tubing spool 24 also includes a tubing spool bore 34 that connects the tree bore 32 to the well 16. Thus, the tubing spool bore 34 may provide access to the well bore 20 for various completion and worker procedures. For example, components may be run down to the wellhead 12 and disposed in the tubing spool bore 34 to seal-off the well bore 20, to inject chemicals down-hole, to suspend tools down-hole, to retrieve tools down-hole, and the like.

As will be appreciated, mineral extractions systems 10 are often exposed to extreme conditions. For example, during drilling and production of a well 16, the well bore 20 may include pressures up to and exceeding 10,000 pounds per square inch (PSI). Accordingly, mineral extraction systems 10 generally employ various mechanisms, such as seals and valves, to control and regulate the well 16. For instance, the hanger 26 (e.g., tubing hanger or casing hanger) that is disposed within the wellhead 12 secures tubing and casing suspended in the well bore 20, and provides a path for hydraulic control fluid, chemical injections, and the like to be passed down-hole. Accordingly, the hanger 26 may include an annular seal 36 that is compressed in an annular region between a body of the hanger 26 and the wellhead 12, to seal off the annular region. The annular seal 36 may prevent pressures in the well 16 from manifesting through the wellhead 12, and enable regulation of the pressure in the annular region and the well 16.

The annular seal 36 may be provided as a component that is installed and seated after the hanger 26 has been landed in the wellhead 12 (e.g., the tubing spool 24). In other words, the hanger 26 may be run down to a subsea wellhead 12, followed by the installation of the seal 36. Installation of the annular seal 36 may include procedures such as seating and locking the seal 36 (e.g., compressing the seal such that is does not become dislodged). Accordingly, installation of the seal 36 may include the use of several tools 28 and procedures to seat and lock the seal 36. For example, the seal 36 may be run from a drilling vessel to the wellhead 12 via a seal running tool 28 attached to the drill stem 30, the running tool 28 may be retrieved, a second tool 28 may be run to the wellhead 12 to seat the seal 36, the second tool 28 may be retrieved, a third tool 28 may be run down to lock the seal 36, and the third 28 tool may be retrieved. Unfortunately, each running procedure may involve a significant amount of time and cost. For example, each run of a tool 28 may take several hours, which may translate into a significant cost when operating an offshore vessel. Further, the use of multiple tools may increase complexity and cost. The following embodiments disclose a system and method that may provide for running, seating, and locking the seal 36 in a mineral extraction system 10. For example, certain embodiments include a running tool and an annular seal that may enable running the annular seal to the wellhead 12, rotating the annular seal and tool in a single direction to seat (e.g., compress) and lock (e.g., preload) the annular seal, and retrieving the annular seal running tool in a single trip.

Figure 2A:
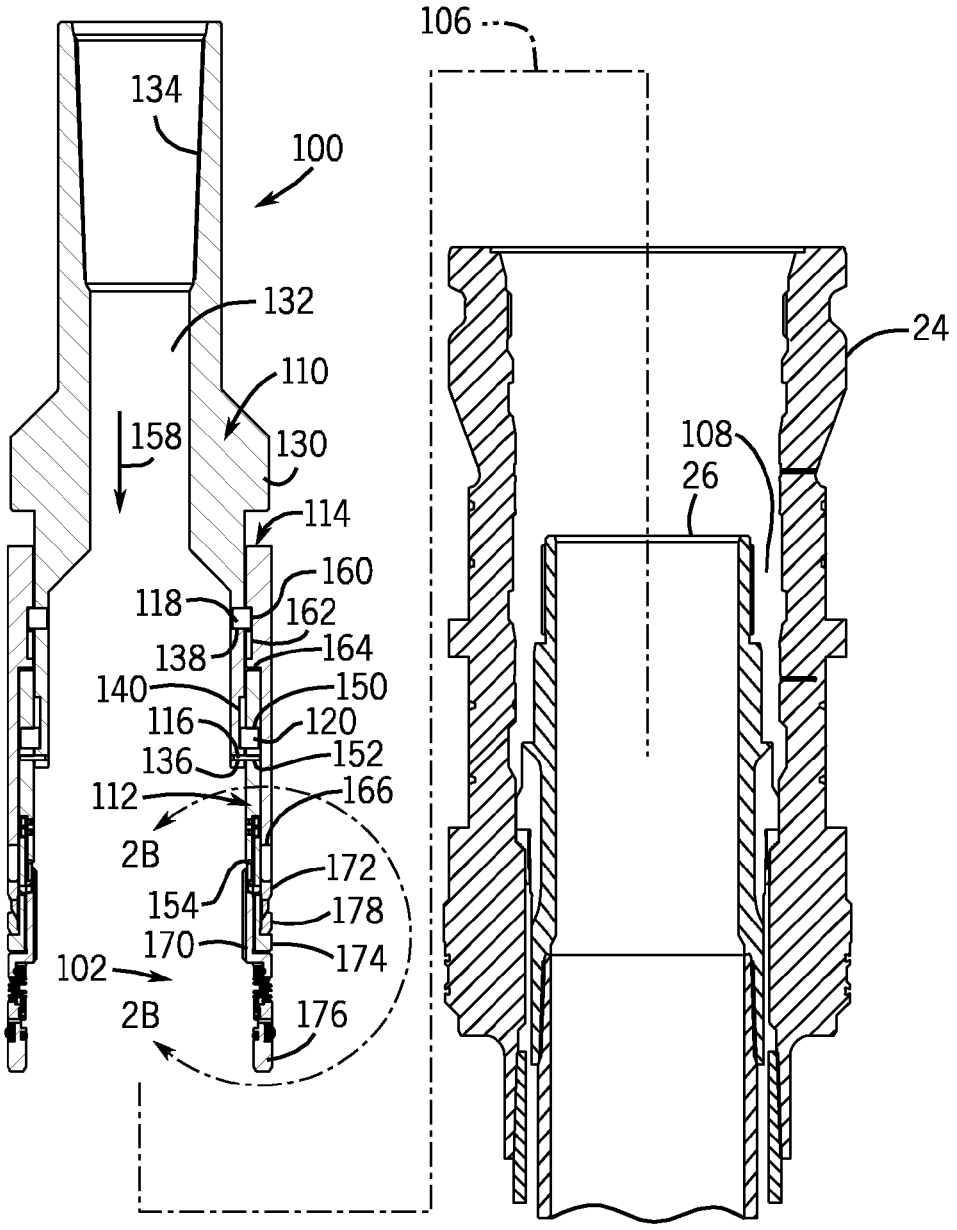
FIG. 2A illustrates an embodiment of a single-trip annular seal running tool, a single trip annular seal, a tubing hanger, and a tubing spool of the mineral extraction system of FIG. 1.
Figure 2B:
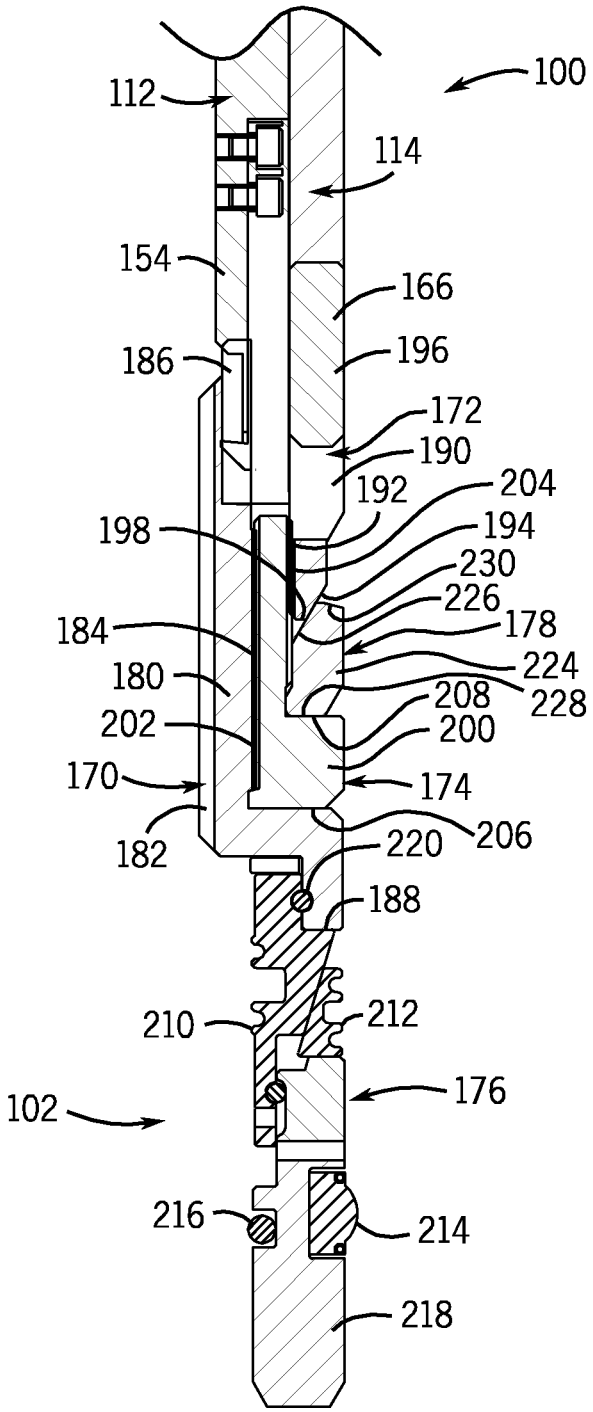
FIG. 2B illustrates a view of the area 2B of FIG. 2A.

FIGS. 2A and 2B illustrate an exemplary embodiment of a single-trip annular seal running tool 100 and a single-trip annular seal 102. The single-trip annular running tool 100 may be attached to the single-trip annular seal 102 such that the single-trip running tool 100 and the single-trip annular seal 102 are run down to a seal location, the seal 102 may be seated and locked, and the single-trip annular seal running tool 100 may be retrieved, leaving the single-trip annular seal 102 seated and locked in place. For example, in the illustrated embodiment, the single-trip annular seal running tool 100 and the singe-trip annular seal 102 are coupled together such that they may be guided into the tubing spool 24 via a path 106. Subsequent to seating and locking the seal 102, the running tool 100 may be retrieved, leaving the seal 102 to seal an annular region 108 between the tubing spool 24 and the hanger 26. In certain embodiments, seating (e.g., compress) and locking (e.g., preloading) the annular seal 102 may include rotating the running tool 100 in a single direction. For example, rotating in one direction may seat the seal 102, engage a locking mechanism, and preload the locking mechanism to retain the seal 102.

The single-trip running tool 100 may include various components that are conducive to seating and locking the seal 102. For example, in the illustrated embodiment, the running tool 100 includes a coupler 110, an inner body 112, an outer body 114, shear pins 116, engagement pins 118, and catch pins 120. The coupler 110 includes a coupler body 130 having a coupler bore 132, a coupler thread 134, shear pin holes 136, engagement holes 138, and a recessed catch groove 140. The inner body 112 includes catch pin holes 150, shear pin holes 152, and hooks 154. The outer body 114 includes an annular groove 160, an engagement groove 162, a recess 164, and fingers 166. In one embodiment, the single-trip running tool 100 may provide a plurality of operations associated with the wellhead 12. For example, the single-trip tool 100 may include functionality that enables the tool to sequentially engage and rotate a first portion of the seal 102 via the inner body 112, and engage and rotate at least a second portion of the seal 102 via the outer body 114. Thus, the single-trip running tool 100 may engage multiple components of the single-trip annular seal 102 to seat and lock the seal 102 in a single-trip, i.e., without multiple trips and multiple tools traveling up and down between an offshore vessel and the wellhead.

In one embodiment, operation may include transmitting a torque from the coupler 110 to the inner body 112 via shear pins 116, and transmitting torque from the coupler 110 to the outer body via the engagement pins 118. In the illustrated embodiment, a torque may be provided to the coupler 110 via drill stem 30 disposed in the coupler thread 134. For example, the drill stem 30 may extend from an offshore vessel, terminate into the coupler thread 134, and be rotated (e.g., via a machine located on the offshore vessel) to provide a rotation and/or torque to the coupler 110. Other embodiments may include torque provided via a drive shaft coupled to the coupler 110, or other sources of torque.

In a first stage of operation, the torque is transferred via the coupler body 130 to the shear pins 116 disposed in the shear pin holes 136. Accordingly, the torque may be transmitted to the inner body 112 via a portion of the shear pins 116 disposed in the shear pin holes 152 of the inner body 112. Further, the torque is transmitted from the inner body 112 to other components within the system 10. In one embodiment, engagement features may couple the inner body 112 to other components of the system 10. For example, the hooks 154 (e.g., j-hooks) disposed on the bottom of the inner body 112 may couple to a first portion of the seal 102. In certain embodiments, the hooks 154 may include fingers that engage complementary notches of the seal 102. Further, in one embodiment, the hooks 154 include fingers that engage the seal 102 during installation of the seal, and are replaced by j-hooks when the tool is used to retrieve the seal 102. For example, the tool 100 is lowered to engage the seal 102 via the fingers in an installation mode of operation, and lowered with j-hooks that can engage the seal 102 provide an axial force to remove the seal 102, in a retrieval mode of operation. Accordingly, in one embodiment, the tool 100 may rotate a first portion of the seal 102 via the hooks 154 or other engagement features.

In this first stage of operation, a significant torque may not be transmitted to the outer body 114 portions because the engagement pins 118 that extend into outer body 114 are disposed in the annular groove 160. In one embodiment, the annular groove 160 may extend about the internal diameter of the outer body 114, and thus, the engagement pins 118 are free to rotate with the coupler 110 without transmitting a significant rotational torque to the outer body 114. However, it should be noted that the outer body 114 may still receive a rotational torque via friction, interference, and the like between the coupler 110 and the inner body 112.

In a second stage of operation, the torque is transmitted from the coupler 110 to the outer body 114 via the engagement pins 118. For instance, where the torque is initially transmitted to the inner body 112 via the shear pins 116, a transition occurs such that the inner body 112 no longer receives a significant torque from the coupler 110. In the illustrated embodiment, the shear pins 116 may be sheared at an interface between the inner body 112 and the outer body 114. For example, the hooks 154 of the inner body 112 may be restricted from moving (e.g., held in place or the seal 102 may be seated) such that applying a sufficient torque to the coupler 110 may shear the shear pins 116. In another embodiment, the shear pins 116 may be sheared via an axial loading (e.g., in the direction of arrow 158) that urges the inner body 112 and the coupler 110 to slide relative to one another. Further, the amount of force to shear the shear pins 116 may be controlled by several variables. For instance, the cross-section and number of shear pins 116 may be varied to control the approximate torque or axial load that may shear the pins 116. Accordingly, this may enable the tool 100 to apply a sufficient torque via the inner body 112 before the pins 116 shear and disengage the inner body 112 from the coupler 110.

Once the shear pins 116 are sheared, the tool 100 transmits the torque from the coupler 110 to another portion of the tool 100. For example, in the illustrated embodiment, when the shear pins 116 are sheared, gravity may slide the coupler body 130 in the direction of the arrow 158. Thus, the coupler body 130 may slide such that the catch pins 150 move relative to the recessed catch groove 140. In one embodiment, the catch groove 140 may include a recessed portion that extends about the outer diameter of the coupler body 130. Further, the engagement pins 118 may slide from the annular notch 160 into the engagement grooves 162. Thus, the engagement pins 118 may engage the engagement grooves 162 such that the torque is transmitted to the outer body 114. For example, in one embodiment, the engagement grooves 162 includes multiple axial/vertical notches disposed about the internal diameter of the outer body 114 such that the engagement pins 118 may drop axially/vertically (e.g., in the direction of the arrow 158) into the grooves 162, and transfer torque via walls of the grooves 162. Thus, in the second stage of operation, the tool 100 may transmit the torque to the outer body 114. For example, in the illustrated embodiment, the torque applied to the coupler 110 is transmitted to the outer body 114 via the coupler body 130, the engagement pins 118, and the engagement grooves 162. Accordingly, the torque is transferred to a second location in the system 10. In one embodiment, the outer body 114 includes engagement features that couple the outer body 114 to other components of the system 10. For example, the fingers 166 disposed on the bottom of the outer body 114 may couple to a second portion of the seal 102. Accordingly, torque applied to the tool 100 in the second stage of operation may rotate the second portion of the seal 102.

In the second stage of operation, a significant torque may not be transmitted to the inner body 112. For example a lack of coupling between the coupler 110 and the inner body 112 (e.g., the shearing of the shear pins 116) reduces the torque transmitted to the inner body 112, and thus, the inner body 112 may rotate independently of the coupler 110 and the outer body 114. However, it should be noted that the inner body 112 may still receive a rotational torque via friction, interference, and the like between the coupler 110 and the outer body 112.

Turning now to the single-trip annular seal 102, embodiments include various components and features that are conducive to seating and locking the seal 102 in a single-trip with a single tool 28 (e.g., the single-trip seal running tool 100). For example, in the illustrated embodiment of FIGS. 2A and 2B, the seal 102 includes an inner energizing member 170, an outer energizing member 172, a load ring 174, an annular seal 176, and a lock ring 178. The inner energizing member 170 includes an inner energizing member body 180 having an inner energizing member first thread 182, an inner energizing member second thread 184, hooks 186, and a seal engagement surface 188. The outer energizing member 172 includes an outer energizing member body 190 having an outer energizing member thread 192, a lock ring engagement surface 194, notches 196, and a bottom surface 198. The load ring 174 includes a body 200 having a load ring first thread 202, a load ring second thread 204, a lower surface 206, and an upper surface 208. The annular seal 176 includes an inner seal 210, an outer seal 212, a first test seal 214, a second test seal 216, a seal carrier 218, and bearings 220. The inner and outer seals 210 and 212 may include CANH seals manufactured by Cameron of Houston, Tex. The lock ring 178 includes a lock ring body 224, having a lock ring chamfer 226, a lock ring lower surface 228, and a lock ring engagement surface 230.

In one embodiment, seating and locking the seal 102 includes rotating the inner energizing member 170, rotating the outer energizing member 172, and rotating the load ring 174. Rotating the inner energizing member 170 provides an axial load to seat and seal the inner and outer seals 210 and 212. Rotating the outer energizing member 172 engages the lock ring 178, and rotating the load ring 174 preloads the lock ring 178 to retain the seal 102. In certain embodiments, rotation of the inner energizing member 170, the outer energizing member 172, and the load ring 174 may be provided via the single-trip seal running tool 100. For example, torque is transmitted via the inner body 112 of the tool 100 to rotate the inner energizing member 170, and torque is transmitted via the outer body 114 of the tool 100 to rotate the outer energizing member 172 and the load ring 174. Similar to the discussion of the single-trip annular seal running tool 100, rotation of each of the components of the seal 102 may be provided sequentially during multiple stages of operation.

Figure 3A:
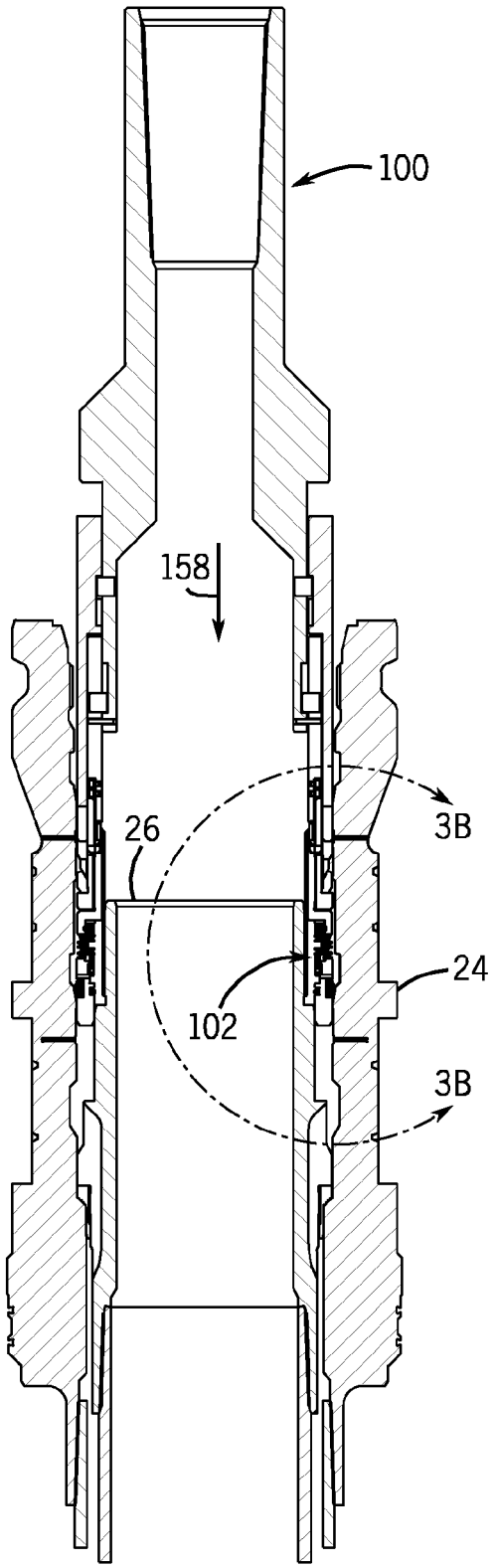
FIG. 3A illustrates an embodiment of the single-trip annular seal running tool, the single trip annular seal, the tubing hanger, and the tubing spool of the mineral extraction system of FIG. 2A in a first position.
Figure 3B:
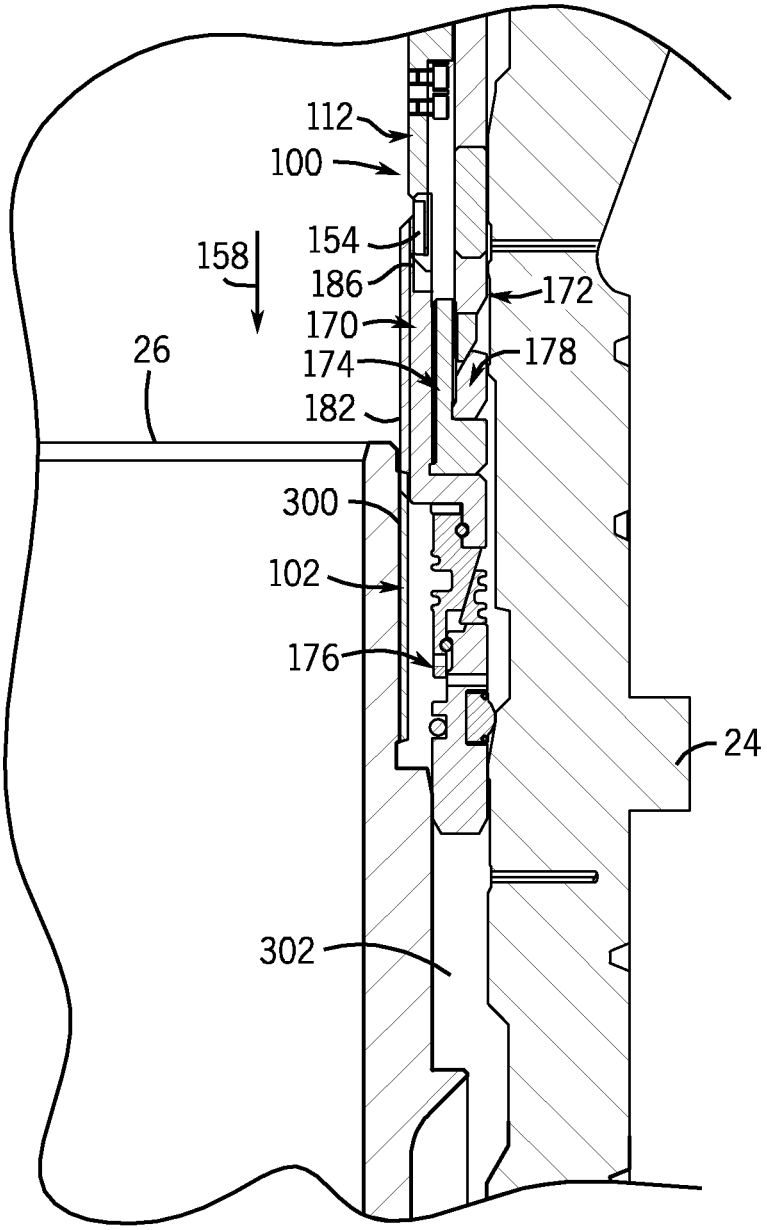
FIG. 3B illustrates a view of the area 3B of FIG. 3A.

FIGS. 3A and 3B illustrate a first stage of sealing in accordance with an exemplary embodiment. In the first stage, the seal 102 is lowered into a first position between the hanger 26 and the tubing spool 24. For example, in the illustrated embodiment, the seal 102 is coupled to the running tool 100 and is lowered in the direction of arrow 158 until the inner energizing member first thread 182 contacts/engages a hanger thread 300. Accordingly, lowering includes moving the annular seal 176 into an annular sealing region 302 between the hanger 26 and the tubing spool 26. In certain embodiment, lowering the running tool 100 and the seal 102 may be accomplished via the drill stem 30. Further, embodiments may include lowering without rotating the drill stem 30, the tool 100, and/or the seal 102. Other embodiments may include rotating the drill stem 30, the tool 100, and/or the seal 102 as they are lowered.

In a second stage, the annular seal 102 is rotated to move the seal 102 in the direction of arrow 158. For example, in one embodiment, the energizing member first thread 182 and the hanger thread 300 both include a right-hand thread type, such that clockwise rotation of the seal 102 causes the seal to thread onto the hanger 26. Accordingly, clockwise rotation of the inner energizing member 170 moves the seal 102 in the direction of the arrow 158. Further, in an exemplary embodiment, the outer energizing member 172, the load ring 174, and the lock ring 178 rotate with the inner energizing member 170. For example, in the illustrated embodiment, the outer energizing member 172, the load ring 174, and the lock ring 178 are disposed around the inner energizing member 170, and have a clearance from the tubing spool 24 such that there is minimal resistance to the components rotating with the inner energizing member 170.

The torque to rotate the inner energizing member 170 may be provided from a plurality of sources. In the illustrated embodiment, the running tool 100 is coupled to the seal 102 such that rotation of the running tool 100 rotates the seal 102. For example, in one embodiment, hooks 154 of the inner body 112 of the tool 100 engage complementary hooks 186 of the inner energizing member 170. Accordingly, operation of the running tool 100 in the first stage as discussed with regard to FIG. 2 may provide a torque to the inner energizing member 170 sufficient to rotate the inner energizing member 170. In other embodiments, rotation of the inner energizing member 170 may be provided by other tools 28, devices, manual labor, and the like.

Figure 4A:
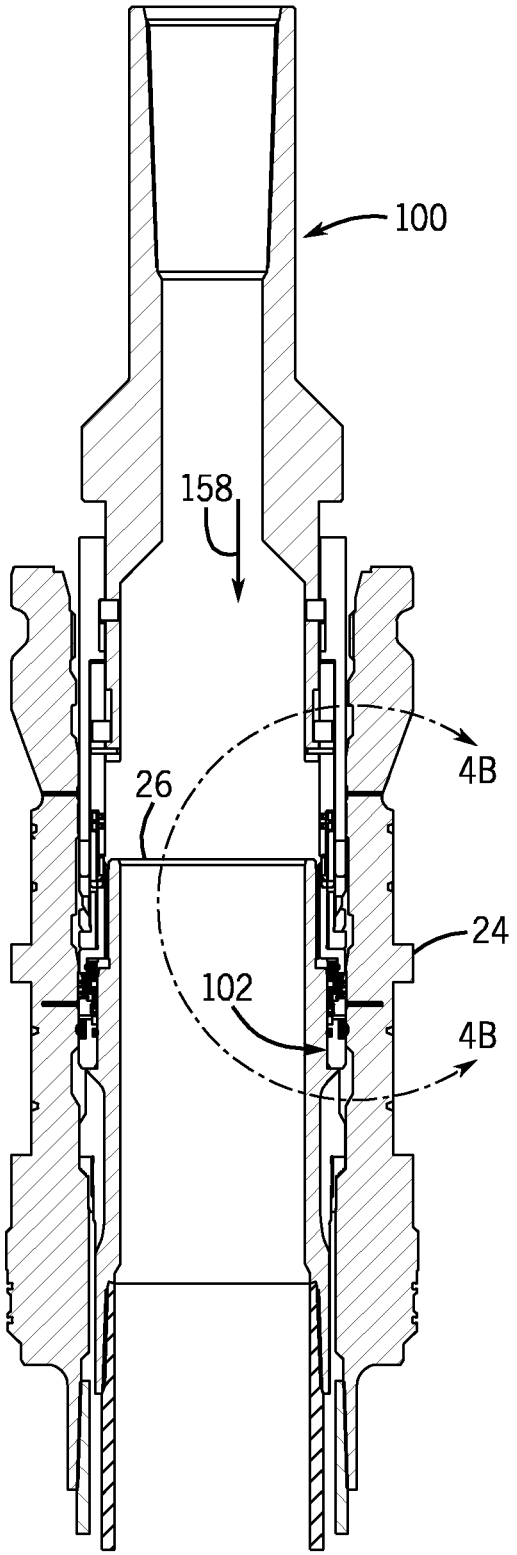
FIG. 4A illustrates an embodiment of the single-trip annular seal running tool, the single trip annular seal, the tubing hanger, and the tubing spool of the mineral extraction system of FIG. 2A in a second position.
Figure 4B:
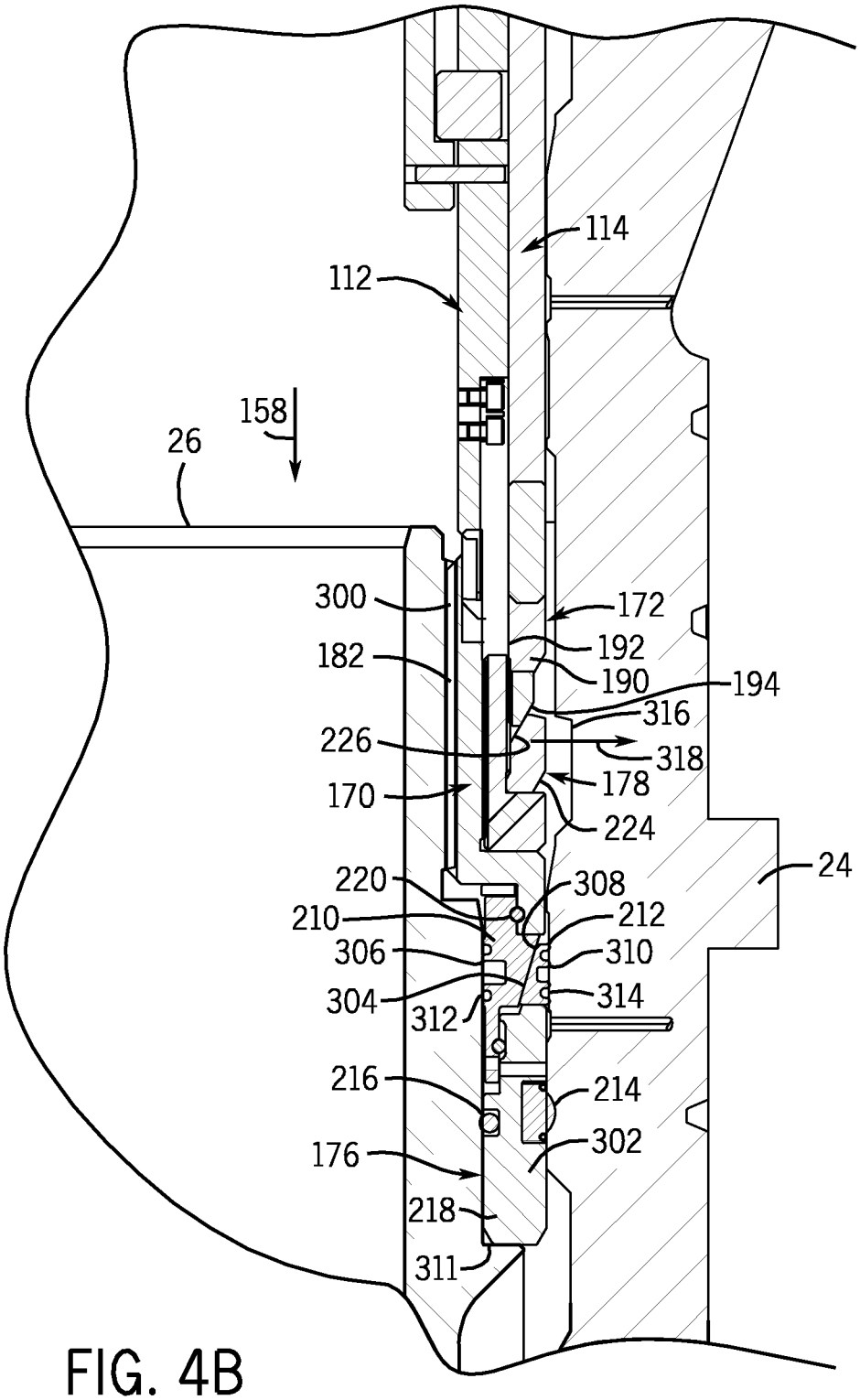
FIG. 4B illustrates a view of the area 4B of FIG. 4A.

The seal 102 may be rotated until the seal 102 is seated. In one embodiment, the energizing ring 170 is rotated until the annular seal 176 is moved into the sealing region 302. For example, FIGS. 4A and 4B illustrate an embodiment with inner energizing member 170 threaded onto the hanger thread 300, and the annular seal 176 is disposed into the sealing region 302. Further, an embodiment includes continuing to rotate the seal 102 to energize the inner and outer seals 210 and 212. For example, in the illustrated embodiment, the inner seal 210 includes an angled surface 304 and sealing protrusions 306, and the outer seal 212 includes an angled surface 308 and sealing protrusions 310. Accordingly, providing an axial load to the annular seal 176 (e.g., compressing the annular seal 176) causes the angled surface 304 of the inner seal 210 and angled surface 308 of the outer seal 212 to wedgingly engage one another such that the seals 210 and 212 are biased inward and outward. For example, providing an axial load in the direction of arrow 158 causes the sealing protrusions 306 and 310 to engage a first sealing surface 312 of the hanger 26 and a second sealing surface 314 of the tubing spool 24, respectively. The seals 210 and 212 may provide a fluid seal of the annular region (e.g., sealing region 302) between the hanger 26 and the tubing spool 24.

The axial load in the direction of arrow 158 provided by rotating the inner energizing member 170. For example, the inner energizing member 170 is rotated such that the seal carrier 218 is seated on a hanger seating surface 311, and the inner energizing member 170 is further rotated to provide an axial load in the direction of arrow 158 that compresses the inner and outer seals 210 and 212. In one embodiment, the axial load may be controlled by the tool 28 (e.g., the seal running tool 100) that is used to rotate the seal 102. For example, in one embodiment, the shear pins 116 of the seal running tool 100 may be varied in design and number to shear at a torque corresponding to the desired axial force to seat the annular seal 176. In other words, the axial force in the direction of arrow 158 may be regulated via the amount of torque transferred via the shear pins 116 of the seal running tool 100.

The seal 102 also includes other features conducive to the rotation of the inner energizing member 170. In one embodiment, as the annular seal 176 is lowered into the sealing region 302, the annular seal 176 does not rotate with the inner energizing member 170 due to interferences with the hanger 26 and the tubing spool 24. These interferences may include the first test seal 214 and the second test seal 216 contacting the sealing surfaces 312 and 314, and creating a resistance to rotation. To prevent undue rotation of the annular seal 176, the seal 102 includes devices to enable independent rotation of the inner energizing member 170 and the annular seal 176. For example, in the illustrated embodiment, the interface between the inner seal 210 and the inner energizing member 170 includes bearings 220 (e.g., ball bearings). Accordingly, the bearings 220 enable the inner energizing member 170 to rotate relative to the annular seal 176 with minimal resistance between the inner energizing member 170 and the annular seal 176. For example, as the first test seal 214 and the second test seal 216 contact the first sealing surfaces 312 and 314, the annular seal 176 may not rotate as it is disposed into the sealing region 302.

Further, it is noted that the second stage may also include rotating the energizing member 170 such that the lock ring 178 is aligned with a complementary locking feature. For example, in the illustrated embodiment, rotating the inner energizing member 170 also aligns the lock ring 178 with a locking recess 316 in the tubing spool 24.

A third stage includes biasing the lock ring 178 outward such that the lock ring 178 may engage a complementary locking feature (e.g., the locking recess 316). For example, in the illustrated embodiment, the lock ring 178 includes a c-ring (e.g., a circular ring with a cut in the diameter) body 224 that is disposed around the load ring 174. The lock ring 178 includes an inward biased set such that a radial force is applied in the direction of arrow 318 to expand the ring outward. The radial force in the direction of arrow 318 is supplied via the outer energizing member 172. For example, in the illustrated embodiment, the outer energizing member thread 192 includes a thread direction that is the same as the inner energizing member first thread 182 (e.g., a right hand thread), such that rotating the outer energizing member 172 in the same direction as the inner energizing member 170 (e.g., clockwise) causes the outer energizing member body 190 to bias the lock ring 178 outward in a radial direction (e.g., in the direction of the arrow 318). In other words, rotating the outer energizing member 172 clockwise moves the outer energizing member body 190 in the direction of arrow 158 such that the lock ring engagement surface 194 wedgingly engages the lock ring chamfer 226, and causes the lock ring 178 to expand radially. In one embodiment, expanding the lock ring 178 radially disposes the lock ring body 224 into the locking recess 316 of the tubing spool 24.

Figure 5A:
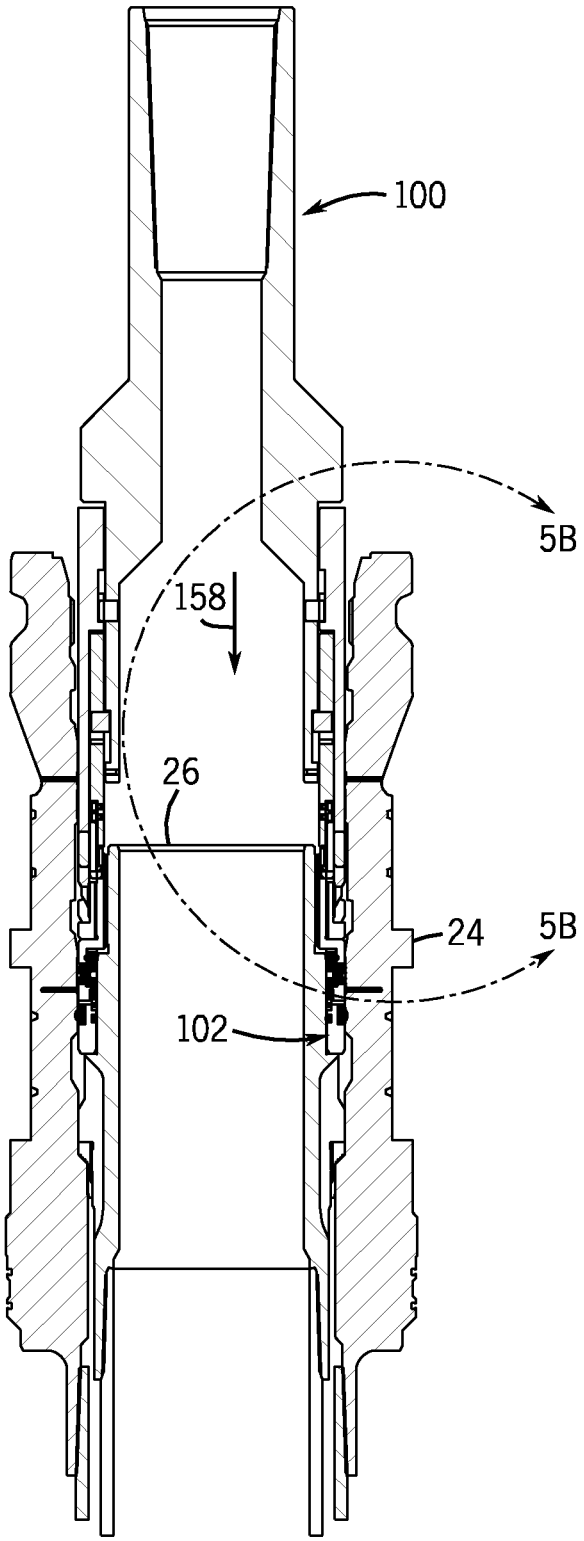
FIG. 5A illustrates an embodiment of the single-trip annular seal running tool, the single trip annular seal, the tubing hanger, and the tubing spool of the mineral extraction system of FIG. 2A in a third position.
Figure 5B:
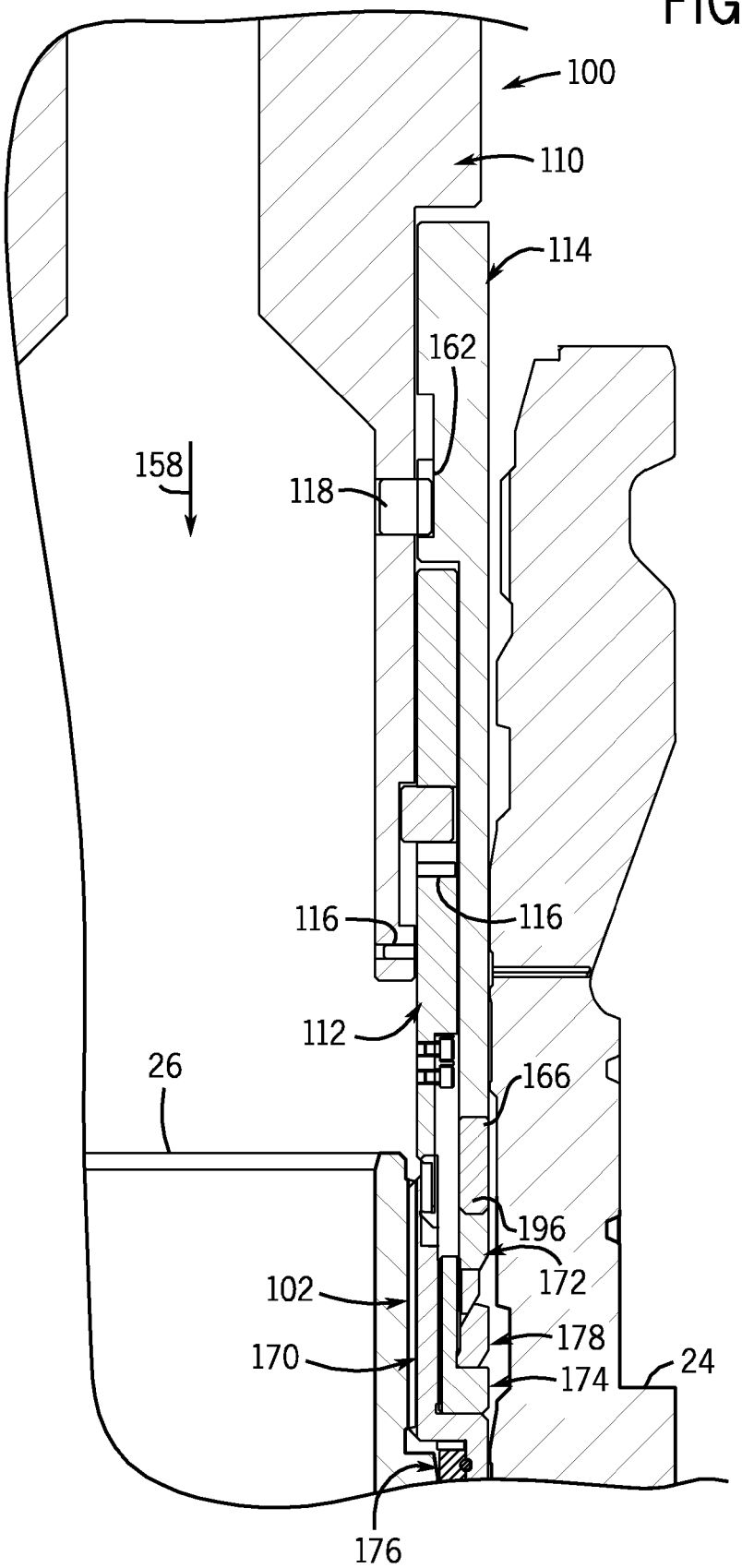
FIG. 5B illustrates a view of the area 5B of FIG. 5A.

Rotation of the outer energizing member 172 may be provided from a plurality of sources. In the illustrated embodiment, the torque to rotate the outer energizing member 172 may be provided via the single-trip seal running tool 100. For example, in one embodiment, sufficient torque is applied to the seal via the inner body 112 of the tool 100 to seat the seal 102 as discussed previously, and a sufficient torque may be applied to the tool 100 to shear the shear pins 116. As illustrated in FIGS. 5A and 5B, and discussed previously with regard to the operation of the tool 100, shearing the shear pins 116 may enable the coupler 110 to disengage the inner body 112 and enable the coupler 110 to engage the outer body 114 via the engagement pins 118 that slide in the direction of arrow 158 and into the engagement grooves 162. Thus, the outer body 114 may be configured to engage the outer energizing member 172. For example, in the illustrated embodiment, fingers 166 of the outer body 114 are mated with complementary notches 196 of the outer energizing member 172. Accordingly, the tool 100 may transmit torque to the seal 102 via the outer energizing member 172.

Figure 6A:
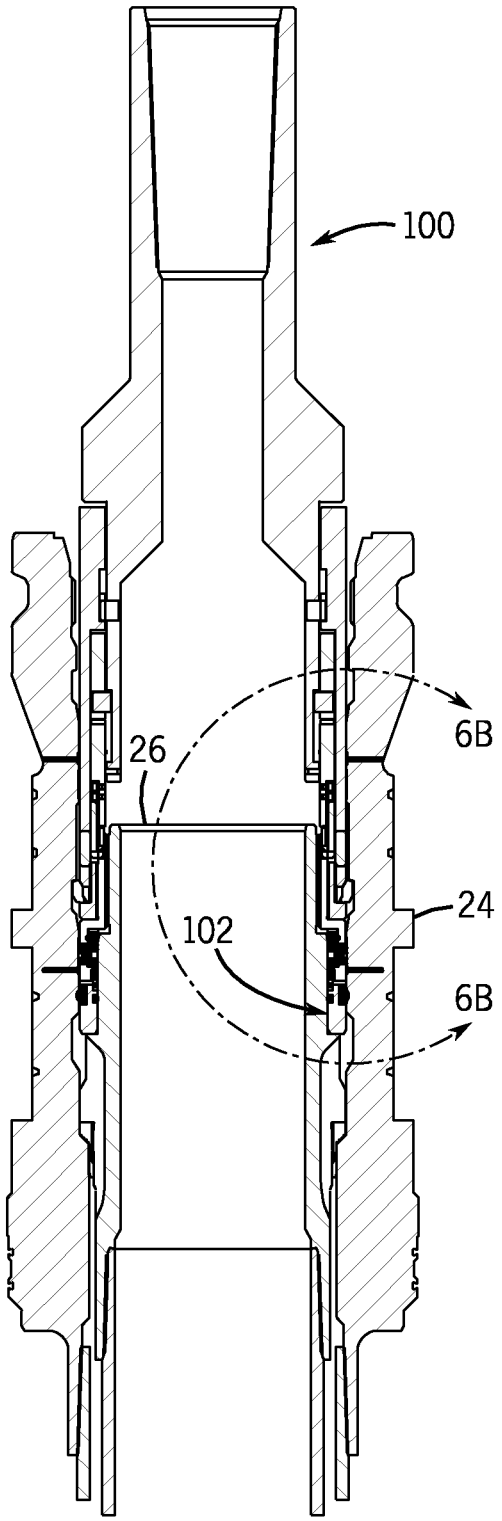
FIG. 6A illustrates an embodiment of the single-trip annular seal running tool, the single trip annular seal, the tubing hanger, and the tubing spool of the mineral extraction system of FIG. 2A in a fourth position.
Figure 6B:
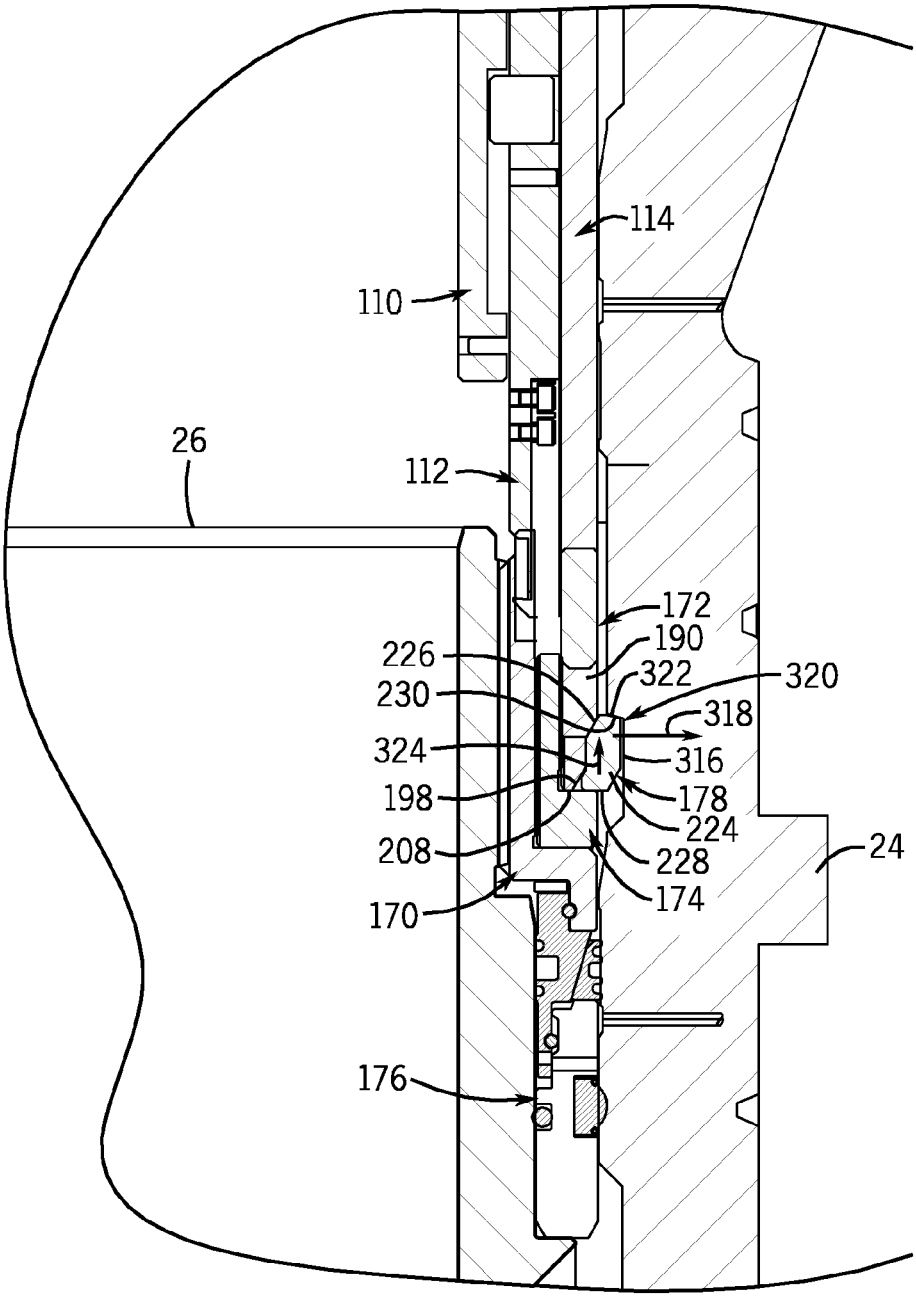
FIG. 6B illustrates a view of the area 6B of FIG. 6A.
Figure 7A:
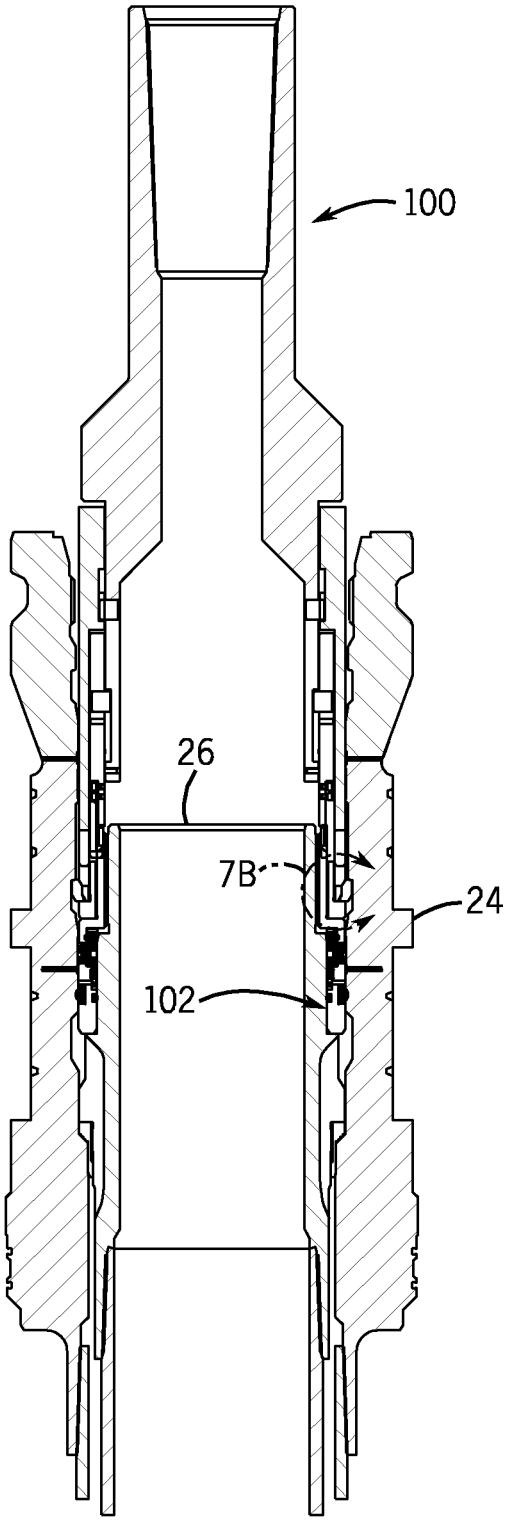
FIG. 7A illustrates an embodiment of the single-trip annular seal running tool, the single trip annular seal, the tubing hanger, and the tubing spool of the mineral extraction system of FIG. 2A in a fifth position.
Figure 7B:
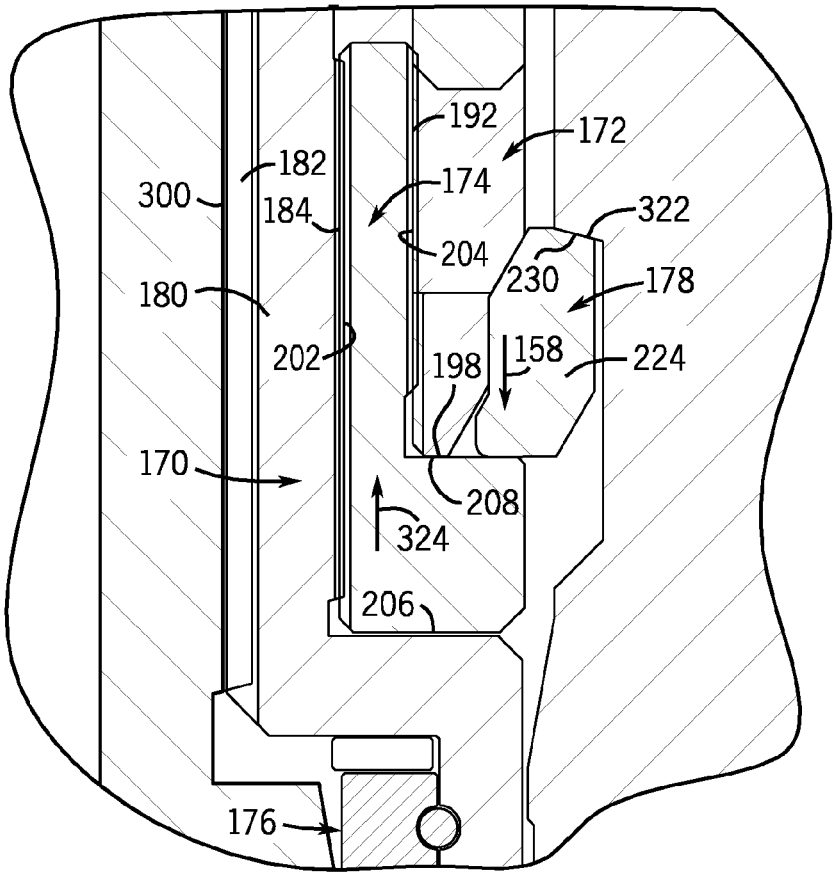
FIG. 7B illustrates a view of the area 7B of FIG. 7A.

FIGS. 6A and 6B illustrate the lock ring 178 biased outward into the locking recess 316. For example, in the illustrated embodiment, the outer energizing member 172 is rotated such that the outer energizing member body 190 wedgingly engaged the lock ring 178, and the bottom surface 198 of the outer energizing member 172 contacts the upper surface 208 of the load ring 174. As illustrated, when the lock ring 178 is biased outward in the direction of arrow 318, a gap 320 may exists between the lock ring engagement surface 230 and a locking surface 322 of the locking recess 316. However, to lock the annular seal 176 in place, in one embodiment, the lock ring 178 may have an axial force applied to it in the direction of arrow 158. The axial force may secure the seal 102 to prevent it from backing out under extreme pressures and other conditions the seal 102 may experience. One embodiment includes urging the lock ring 178 in the direction of arrow 324 to react the lock ring engagement surface 230 against the locking surface 322. Reacting engagement surface 230 against the locking surface 322 provides an axial force (e.g., preload) that secures the seal 102 in place relative to the hanger 26 and the tubing spool 24. For example, the lock ring 178 is moved in the direction of arrow 324 by rotating the load ring 174. For example, FIGS. 7A and 7B illustrate an embodiment having the load ring 174 rotated such that the lower surface 206 of the load ring 174 is moved away from the inner energizing member 170. Accordingly, applying a torque to rotate the load ring 174 provides an axial load to the lock ring 178 in the direction of arrow 158 via the engagement of the lock ring engagement surface 230 and the locking surface 322.

Rotation of the load ring 174 may be provided from a plurality of sources. In the illustrated embodiment, a torque applied to the outer energizing member 172 is transmitted to the load ring 174. For example, in one embodiment, the inner energizing member second thread 184 and the load ring first thread 202 include complementary threads (e.g., internal thread and external threads) that include a thread direction that is opposite from the thread direction of the inner energizing member first thread 182, the load ring second thread 204, and the outer energizing member thread 192. For example, in an embodiment where the inner energizing member first thread 182, the load ring second thread 204, and the outer energizing member thread 192 include a right hand thread direction, the inner energizing member second thread 184, and the load ring first thread 202 may include a left hand thread direction. Accordingly, once the bottom surface 198 of outer energizing member 172 has contacted the upper surface 208 of the load ring 174, continuing to provide a clockwise torque or rotation to the outer energizing member 172 causes the load ring 174 to rotate clockwise, and move in the direction of arrow 324. As discussed previously, movement of the load ring 174 locks the seal 102 into place via contact between the lock ring engagement surface 230 and the locking surface 322. As will be appreciated, one embodiment may include the inner energizing member first thread 182, the load ring second thread 204 and the outer energizing member thread 192 including a left hand thread direction, and the inner energizing member second thread 184 and the load ring first thread 202 having a thread type including a right hand thread direction.

In one embodiment, rotation of the load ring 174 is provided via continuing to rotate the tool 100 in the same direction as the tool 100 is rotated to seat the seal 102 and to bias the lock ring 174 in the direction of arrow 318. For example, once the bottom surface 198 of outer energizing member 172 has contacted the upper surface of the load ring 174, continuing to provide a clockwise torque or rotation to the outer energizing member causing the load ring 174 to move in the direction of arrow 324. As discussed previously, movement of the load ring 174 locks the seal 102 into place via contact between the lock ring engagement surface 230 and the locking surface 322.

Figure 8:
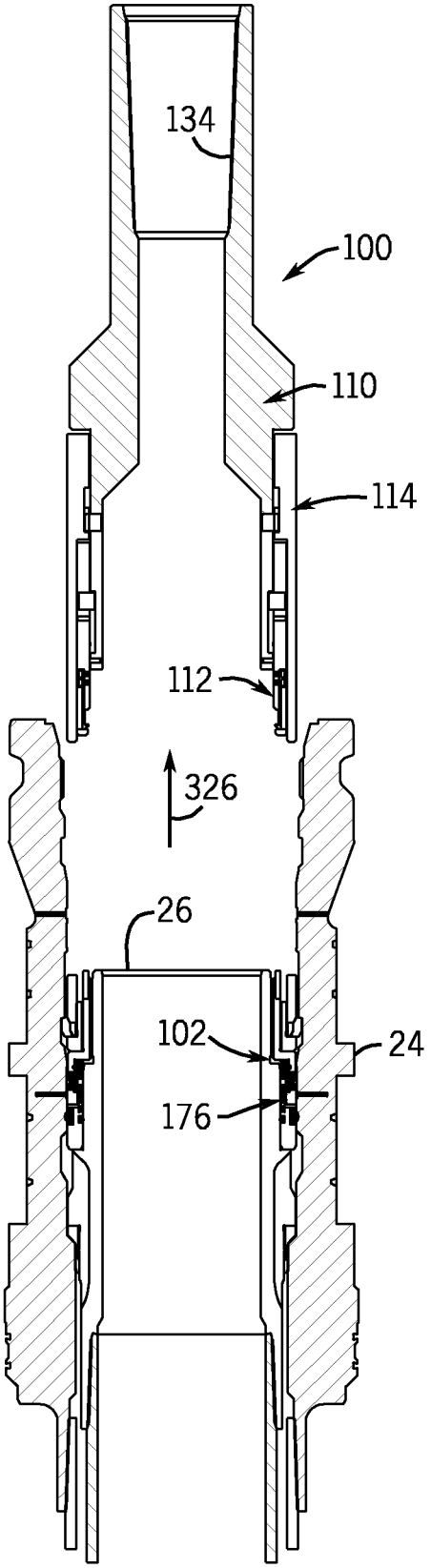
FIG. 8 illustrates an embodiment of the single-trip annular seal running tool, the single trip annular seal, the tubing hanger and the tubing spool of the mineral extraction system of FIG. 2A in a sixth position.

Subsequent to providing a sufficient torque to preload the lock ring 178, the tool 100 is disengaged from the seal 102 and is retrieved. For example, in as illustrated in FIG. 8, the tool 100 is retrieved in the direction of arrow 326 to disengage the fingers 166 and the hooks 154 from the notches 196 and the hooks 186 prior to returning the tool 100 in the direction of arrow 326. Accordingly, disengaging and retrieving the tool 100 may leave the seal 102 seated and locked. In other words, the inner and outer seals 210 and 212 may be wedgingly engaged to seal the annular region 302, the first test seal 214 and second test seal 216 may be mated to the sealing faces 312 and 314, and the lock ring 178 may be preloaded to provide an axial force to retain the seal 102.

Figure 9:
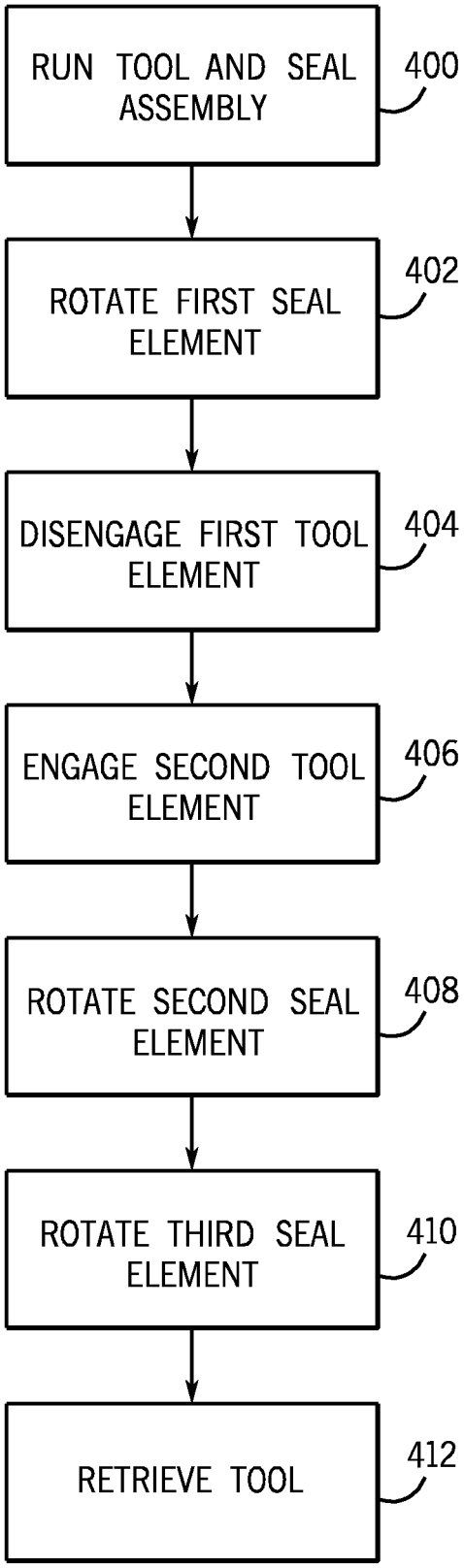
FIG. 9 illustrates a flowchart of an exemplary method of operation of the mineral extraction system of FIG. 1.

FIG. 9 includes a flowchart illustrating an exemplary method for single-trip sealing and locking of the single-trip annular seal 102 in accordance with embodiments of the present technique. As depicted at block 400, the first step may include running the tool and seal assembly. In one embodiment, running the tool and seal assembly (block 400) may include coupling the seal 102 to the tool 100, and running the tool 102 and the seal 100 to the mineral extraction system 10. For example, the tool 102 is coupled to the drill stem 30 and lowered from an offshore vessel via path 106 to engage the hanger 26 and the tubing spool 24.

Subsequent to running the tool and seal assembly (block 400), an embodiment includes rotating a first seal element, as depicted at block 402. For example, in one embodiment, rotating a first seal element (block 402) may include rotating the tool coupler 110 in a first direction (e.g., clockwise) to rotate the inner body 112. Rotating the inner body 112 rotates the inner energizing member 170 in the same direction (e.g., clockwise). Accordingly, rotating the first seal element in the first direction seats the annular seal 176, as discussed previously. Subsequently, the method may include disengaging the first tool element, as depicted at block 404. For example, one embodiment may include continuing to apply torque to the tool 100 in the first direction (e.g., clockwise) until the shear pins 116 shear, and the inner body 112 is disengaged from the coupler 110.

Subsequent to disengaging the first tool element (block 404), an embodiment includes engaging the second tool element, as depicted at block 406. For example, in one embodiment, engaging the second tool element (block 406) includes the engagement pins 118 engaging the engagement grooves 162 such that continuing to rotate the coupler 110 transmits a torque via the outer body 114. Accordingly, the next step may include rotating the second seal element, as depicted at block 408. For example, one embodiment includes rotating the outer energizing member 172 via continuing to rotate the tool 100 in the first direction (e.g., clockwise) until the lock ring 178 is biased outward and the outer energizing ring 172 contacts the load ring 174.

Next, the method includes rotating the third seal element, as depicted at block 410. For example, once the outer energizing ring 172 contacts the load ring 174, the tool 100 is rotated in the first direction (e.g., clockwise) such that the load ring 174 is rotated about the inner energizing ring 170 via the torque transmitted from the outer energizing member 172 and the outer body 114 of the tool 100. Accordingly, rotating the third seal element in the first direction preloads the lock ring 178 and the seal 102. Finally, once the seal 102 has been seated and locked, the method may include retrieving the tool, as depicted at block 412. In one embodiment, retrieving the tool (block 412) may include disengaging the tool 100 from the seal 102, and running the tool back to the surface, for instance.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a subsea tool, comprising:

a first body;

a second body;

a coupler;

a plurality of shear pins disposed between the coupler and the first body, wherein the plurality of shear pins couple the first body to the coupler until a threshold force shears the plurality of shear pins; and a plurality of engagement pins disposed between the coupler and the second body, wherein the plurality of engagement pins selectively move along an annular groove between the coupler and the second body, the annular groove extends in a circumferential direction about an axis, and the plurality of engagement pins selectively move along a respective plurality of axial grooves between the coupler and the second body.

2. The system of claim 1, wherein the plurality of shear pins are configured to transmit a rotational torque from the coupler to the first body until the threshold force shears the plurality of shear pins, wherein the threshold force comprises a threshold torque.

3. The system of claim 1, wherein the second body is configured to rotate relative to the coupler while the plurality of engagement pins are disposed in the annular groove.

4. The system of claim 1, wherein the plurality of engagement pins are configured to transmit a rotational torque from the coupler to the second body while the plurality of engagement pins are disposed in the respective plurality of axial grooves.

5. The system of claim 1, wherein the coupler is configured to engage a drill stem extending from an offshore vessel.

6. The system of claim 1, wherein the subsea tool is configured to transfer torque from the coupler to the first body via the plurality of shear pins in a first stage, the subsea tool is configured to allow the coupler to rotate relative to the second body via movement of the plurality of engagement pins along the annular groove in the first stage, and the subsea tool is configured to transfer torque from the coupler to the second body via the plurality of engagement pins in the respective plurality of axial grooves in a second stage.

7. The system of claim 1, wherein the first body comprises a first seal engagement feature, and the second body includes a second seal engagement feature.

8. The system of claim 1, comprising:

an inner energizing ring configured to rotate in a direction to move the inner energizing ring in a first axial direction to seat a seal;

an outer energizing ring configured to rotate in the direction to wedgingly engage and set a lock ring in a radial direction; and a load ring configured to rotate in the direction to move the load ring in a second axial direction to set the lock ring.

9. A method, comprising:

rotating an inner energizing ring, via rotation of a first body of a running tool relative to a second body of the running tool, in a direction to move the inner energizing ring in a first axial direction to seat a seal;

rotating an outer energizing ring, via rotation of the second body of the running tool relative to the first body of the running tool, in the direction to wedgingly engage and set a lock ring in a radial direction; and rotating a load ring in the direction to move the load ring in a second axial direction to set the lock ring.

10. The method of claim 9, wherein rotating the inner energizing member, rotating the outer energizing member, and rotating the load ring occur sequentially, one after another, via the running tool.

11. The method of claim 9, wherein rotating the inner energizing ring comprises providing an axial load to compress the seal to seal an annular region between tubular members of a mineral extraction system.

12. The method of claim 9, comprising rotating the inner energizing ring about a threaded portion of a wellhead component.

13. The method of claim 9, wherein rotating the load ring comprises:

rotating the load ring, via rotation of the second body of the running tool relative to the first body of the running tool, in the direction to move the load ring in the second axial direction to set the lock ring.

14. The method of claim 9, comprising providing a rotational torque via a drill string of a mineral extraction system that causes rotating the inner energizing ring, rotating the outer energizing ring, and rotating the load ring.

15. The method of claim 9, comprising disposing the seal between tubular members of a mineral extraction system comprising a well, a wellhead, a subsea tree, a mineral deposit, a tool, a tool connector, a valve, a controller, or a combination thereof.

16. The method of claim 9, comprising acquiring a natural resource through a wellhead sealed by the seal.

17. The method of claim 9, wherein:

rotating the inner energizing ring comprises rotating the inner energizing ring, via rotation of the first body of the running tool relative to a coupler of the running tool, in the direction to move the inner energizing ring in the first axial direction to seat the seal; and rotating the outer energizing ring comprises rotating the outer energizing ring, via rotation of the second body of the running tool relative to the coupler of the running tool, in the direction to wedgingly engage and set the lock ring in the radial direction.

18. The method of claim 9, wherein:

rotating the inner energizing ring comprises rotating the inner energizing ring via rotation of the first body of the running tool via torque transfer through one or more shear pins of the running tool until a threshold torque causes shearing of the one or more shear pins.

19. The method of claim 18, wherein:

rotating the outer energizing ring comprises rotating the outer energizing ring after shearing of the one or more shear pins.

20. The method of claim 19, wherein:

rotating the outer energizing ring comprises rotating the outer energizing ring via rotation of the second body of the running tool via torque transfer through one or more engagement pins disposed in one or more axial grooves of the running tool, wherein the one or more engagement pins move from an annular groove into the one or more axial grooves after shearing of the one or more shear pins.

21. The method of claim 9, wherein:

rotating the inner energizing ring comprises rotating the inner energizing ring, via rotation of the first body of the running tool rotationally interlocked with the inner energizing ring via a first interface of one or more first fingers with one or more first notches; and rotating the outer energizing ring comprises rotating the outer energizing ring, via rotation of the second body of the running tool rotationally interlocked with the outer energizing ring via a second interface of one or more second fingers with one or more second notches.

22. A method, comprising:

transmitting via a subsea tool a first torque from a coupler to a first body via a plurality of shear pins;

transmitting via the subsea tool a second torque from the coupler to the first body to shear the shear pins, wherein shearing the shear pins is configured to move a plurality of engagement pins relative to a second body such that the coupler engages the second body via the engagement pins; and transmitting via the subsea tool a third torque from the coupler to the second body via the engagement pins.

23. The method of claim 22, comprising transmitting the first torque to an annular seal via the first body.

24. The method of claim 22, comprising transmitting the third torque to an annular seal via the second body.

25. The method of claim 22, wherein the shear pins are sheared to enable the engagement pins to slide into respective slots disposed in the second body.

26. The method of claim 22, wherein the first torque, the second torque, and the third torque are supplied via a drill stem extending from an offshore vessel.

27. The method of claim 22, wherein the first torque, the second torque, and the third torque are in the same direction.

28. The method of claim 22, comprising sequentially engaging components of a subsea mineral extraction system.

29. The method of claim 22, comprising transmitting the first torque, the second torque, and the third torque to sequentially seat and lock an annular seal in a single trip from an offshore vessel.

30. The method of claim 22, comprising:

rotating an inner energizing ring in a direction to move the inner energizing ring in a first axial direction to seat a seal;

rotating an outer energizing ring in the direction to wedgingly engage and set a lock ring in a radial direction; and rotating a load ring in the direction to move the load ring in a second axial direction to set the lock ring.

31. The method of claim 30, wherein rotating the inner energizing member, rotating the outer energizing member, and rotating the load ring occur sequentially, one after another.

32. A system, comprising:

a subsea tool, comprising:

a first body;

a second body;

a coupler;

a plurality of shear pins disposed between the coupler and the first body; and a plurality of engagement pins configured to couple the coupler and the second body; and an inner energizing ring configured to rotate in a direction to move the inner energizing ring in a first axial direction to seat a seal;

an outer energizing ring configured to rotate in the direction to wedgingly engage and set a lock ring in a radial direction; and a load ring configured to rotate in the direction to move the load ring in a second axial direction to set the lock ring.

* * * * *